US010865457B2

(12) United States Patent
Bellus et al.

(10) Patent No.: US 10,865,457 B2
(45) Date of Patent: Dec. 15, 2020

(54) STEEL COMPOSITION

(71) Applicant: AUBERT & DUVAL, Paris (FR)

(72) Inventors: Jacques Bellus, Saint Genest-Lerpt (FR); Atman Benbahmed, Cormeilles-en-Parisis (FR); Johanna Andre, Uppsala (SE); Fredrik Sandberg, Uppsala (SE)

(73) Assignee: AUBERT & DUVAL, Paris (FR)

( * ) Notice: Subject to any disclaimer, the term of this patent is extended or adjusted under 35 U.S.C. 154(b) by 149 days.

(21) Appl. No.: 16/310,267

(22) PCT Filed: Jun. 16, 2017

(86) PCT No.: PCT/FR2017/051584

§ 371 (c)(1),
(2) Date: Dec. 14, 2018

(87) PCT Pub. No.: WO2017/216500

PCT Pub. Date: Dec. 21, 2017

(65) Prior Publication Data

US 2019/0338383 A1 Nov. 7, 2019

(30) Foreign Application Priority Data

Jun. 17, 2016 (FR) ..... 16 55664

(51) Int. Cl.

| | |
|---|---|
| ***C21D 8/00*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/52*** | (2006.01) |
| ***C23C 8/22*** | (2006.01) |
| ***C23C 8/26*** | (2006.01) |
| ***C23C 8/32*** | (2006.01) |
| ***C23C 8/80*** | (2006.01) |

(52) U.S. Cl.

CPC ..... *C21D 8/005* (2013.01); *C21D 6/004* (2013.01); *C21D 6/005* (2013.01); *C21D 6/007* (2013.01); *C21D 6/008* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/52* (2013.01); *C23C 8/22* (2013.01); *C23C 8/26* (2013.01); *C23C 8/32* (2013.01); *C23C 8/80* (2013.01); *C21D 2211/001* (2013.01)

(58) Field of Classification Search

CPC ..... C22C 38/46; C22C 38/44; C22C 38/42; C22C 38/06; C22C 38/04; C22C 38/02; C22C 38/002; C21D 8/005; C21D 6/008; C21D 6/007; C21D 6/005

See application file for complete search history.

(56) References Cited

U.S. PATENT DOCUMENTS

2004/0187972 A1 9/2004 Ozaki

FOREIGN PATENT DOCUMENTS

| | | |
|---|---|---|
| CN | 102226254 | 10/2011 |
| CN | 102242316 | 11/2011 |
| GB | 2370281 A | 6/2002 |
| WO | 2015082342 A1 | 6/2015 |

OTHER PUBLICATIONS

Office Action issued for Chinese Patent Application No. 201780047104.X, dated Mar. 25, 2020, 16 pages including English translation.

International Search Report issued for International Patent Application No. PCT/FR2017/051584, dated Sep. 1, 2017, 5 pages including English translation.

*Primary Examiner* — Jessee R Roe

(74) *Attorney, Agent, or Firm* — Hamre, Schumann, Mueller & Larson, P.C.

(57) ABSTRACT

The present invention relates to a steel composition carburizable and/or nitritable, comprising, in percentages by weight of the total composition:

Figure 1:
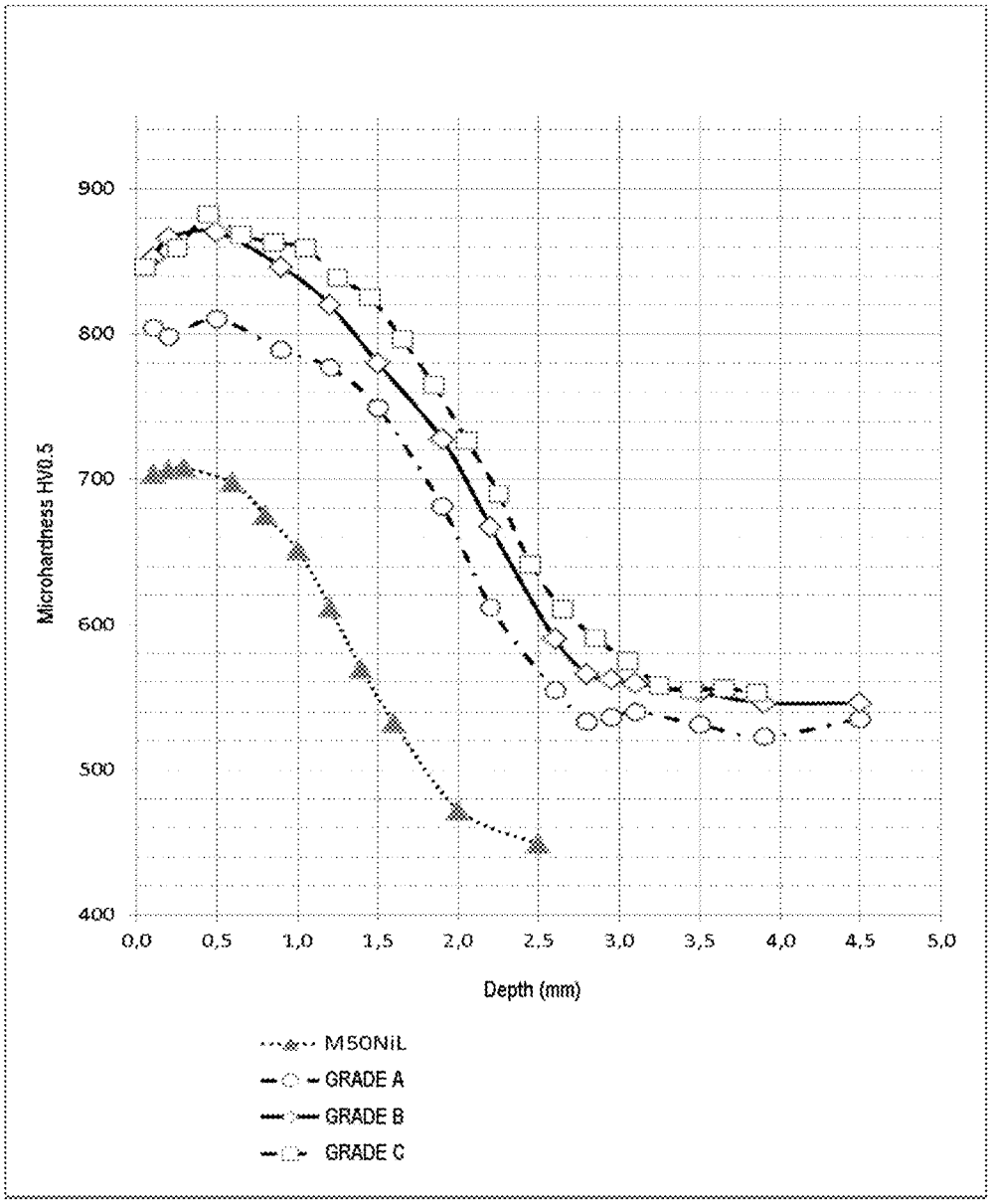

Carbon: 0.05-0.40, preferably 0.10-0.30;
Chromium: 2.50-5.00, preferably 3.00-4.50;
Molybdenum: 4.00-6.00;
Tungsten: 0.01-1.80, preferably 0.02-1.50;
Vanadium: 1.00-3.00, preferably 1.50-2.50;
Nickel: 2.00-4.00;
Cobalt: 2.00-8.00, preferably 3.00-7.00;
Iron: balance as well as the inevitable impurities, optionally further comprising one or more of the following elements:

Niobium: ≤2.00;
Nitrogen: ≤0.50, preferably ≤0.20;
Silicon: ≤0.70, preferably 0.05-0.50;
Manganese: ≤0.70, preferably 0.05-0.50;
Aluminum: ≤0.15, preferably ≤0.10;

the combined niobium+vanadium content being in the range 1.00-3.50;

and the carbon+nitrogen content being in the range 0.05-0.50.

It further relates to the method of production thereof, the steel blank obtained and a mechanical device comprising the latter.

20 Claims, 3 Drawing Sheets

STEEL COMPOSITION

The present invention relates to a new steel of the 20CrMoCo type with low carbon content for thermochemical treatment intended in particular for the field of transmission systems such as bearings and gears.

Bearings are mechanical devices for providing relative movements that are constrained in orientation and direction between two parts. Bearings comprise several components: inner race, outer race and rolling bodies (balls or rollers) arranged between these two races. To ensure reliability and performance over time, it is important that these various elements have good properties in rolling fatigue, wear, etc.

Gear trains are mechanical devices for transmitting power. To ensure a favorable power density (ratio of power transmitted to the overall dimensions of the gear trains) and operational reliability, gear trains must have good properties in structural fatigue (tooth root) and contact fatigue (tooth flank).

Conventional techniques for producing these metallic components employ electric steelmaking processes followed by optional operations of remelting, or single or multiple vacuum remelting. The ingots thus produced are then formed by hot working processes such as rolling or forging in the form of bar, tube or rings.

There are two types of metallurgy for providing the final mechanical properties.

1st Type: the chemical composition of the component allows the mechanical properties to be obtained directly after suitable heat treatment.

2nd Type: the component requires a thermochemical treatment for enriching the surface with interstitial elements such as carbon and nitrogen. This enrichment, generally superficial, with chemical elements then allows high mechanical properties to be obtained after heat treatment to depths of a few millimeters at most. These steels generally have better properties in terms of ductility than the steels of the 1st type. There are also thermochemical processes applied to the steels of the 1st type with the aim of enriching the surface with nitrogen to obtain very high mechanical properties.

The first of the properties required in the field of bearings or gears is to obtain a very high level of hardness. These steels of type 1 and type 2 generally have levels of surface hardness above 58 HRC. The most widely used grades known as M50 (0.8% C-4% Cr-4.2% Mo-1% V), or 50 NiL (0.12% C-4% Cr-4.2% Mo-3.4% Ni-1% V) do not exceed a surface hardness of 63 HRC after optional thermochemical treatment and suitable heat treatment.

Application GB2370281 describes a valve seat steel produced by powder metallurgy technology, from powders compacted from mixtures of powder based on iron and harder particles whose matrix has the following composition, in percentages by weight of the total composition:

Carbon: 0.2-2.0;
Chromium: 1.0-9.0;
Molybdenum: 1.0-9.0;
Silicon: 0.1-1.0;
Tungsten: 1.0-3.0;
Vanadium: 0.1-1.0;
Nickel+cobalt+copper: 3.0-15.0;
Iron: balance However, this matrix comprises from 5 to 40 vol % of pearlite, which results in a lack of ductility of this matrix and therefore embrittlement.

Patent application WO2015/082342 describes a bearing steel having the following composition, in percentages by weight of the total composition:

Carbon: 0.05-0.5;
Chromium: 2.5-5.0;
Molybdenum: 4-6;
Tungsten: 2-4.5;
Vanadium: 1-3;
Nickel: 2-4;
Cobalt: 2-8;
Iron: balance as well as the inevitable impurities, optionally further comprising one or more of the following elements:

Niobium: 0-2;
Nitrogen: 0-0.5;
Silicon: 0-0.7;
Manganese: 0-0.7;
Aluminum: 0-0.15;

and in particular grade MIX5 with the composition 0.18% C-3.45% Cr-4.93% Mo-3.05% W-2.09% V-0.30% Si-2.89% Ni-5.14% Co-0.27% Mn, which is the most interesting as it has the highest surface hardness. This grade makes it possible to reach a surface hardness after solution heat treatment at 1150° C. and tempering at 560° C. at a maximum level of hardness of about 800 HV, or the equivalent of 64 HRC max. (comparative example 1).

It is therefore difficult to obtain surface hardnesses above 64 HRC, in particular using a solution heat treatment at a temperature less than or equal to 1160° C., whereas they would allow a significant improvement in the properties of the component.

The inventors realized that, surprisingly, by lowering the tungsten content of the steel described in application WO2015/082342, the steel obtained had, after thermochemical treatment, in particular carburization and/or nitriding, a very high surface hardness, even greater than or equal to 64 HRC after a solution heat treatment at a temperature in the range 1100° C.-1160° C. and tempering at a temperature greater than or equal to 475° C.

This was not at all obvious from that document, which recommended the use of a high tungsten content such as in grade MIX5 (3% tungsten), which is regarded as the composition having the best hardness.

Patent application US2004/0187972 describes a steel having a tungsten content between 0.5 and 2%. However, said steel has a high carbon content (0.5-0.75%) and therefore carburization and/or nitriding are difficult. Therefore it does not belong to the same technical field as the steels of application WO2015/082342, or the steels according to the present invention.

Furthermore, that document justifies the range of tungsten content between 0.5 and 2% according to paragraph [0035] as follows:

0.5%: contribution to hot hardness by dissolution in the matrix

2%: maximum for greatly limiting the formation of $M_6C$ carbides that are stable at high temperature.

It therefore teaches very well that tungsten is known by a person skilled in the art for its favorable action concerning increase in hardness not only at elevated temperature but also at room temperature. The only reason for limiting its content in that document is therefore to avoid the formation of $M_6C$ carbides, which are stable at high temperature.

Now, the thermodynamic equilibrium of the steel described in that document is notably different from that of application WO2015/082342 or from that according to the present invention.

Thus, the presence of $M_6C$ carbides is not proscribed in the context of the present invention. A person skilled in the art will therefore not try, in view of the teaching of this document, to reduce the amount of tungsten in the steel in application WO2015/082342. He would on the contrary have a tendency to increase it to improve the hardness of this steel.

Thus, the fact that lowering the level of tungsten in the steel in application WO2015/082342 leads to an increase in surface hardness is therefore totally unexpected for a person skilled in the art.

The present invention therefore relates to a steel composition, advantageously carburizable and/or nitritable, more advantageously carburizable, comprising, advantageously consisting essentially of, in particular consisting of, in percentages by weight of the total composition:

Carbon: 0.05-0.40, preferably 0.10-0.30;
Chromium: 2.50-5.00, preferably 3.00-4.50;
Molybdenum: 4.00-6.00;
Tungsten: 0.01-1.80, preferably 0.02-1.50;
Vanadium: 1.00-3.00, preferably 1.50-2.50;
Nickel: 2.00-4.00;
Cobalt: 2.00-8.00, preferably 3.00-7.00;
Iron: balance
as well as the inevitable impurities,
optionally further comprising one or more of the following elements:
Niobium: ≤2.00;
Nitrogen: ≤0.50, preferably ≤0.20;
Silicon: ≤0.70, preferably 0.05-0.50;
Manganese: ≤0.70, preferably 0.05-0.50;
Aluminum: ≤0.15, preferably ≤0.10;
the combined niobium+vanadium content being in the range 1.00-3.50;
and the carbon+nitrogen content being in the range 0.05-0.50.

A particularly advantageous composition comprises, advantageously consists essentially of, in particular consists of, in percentages by weight of the total composition:

Carbon: 0.10-0.30, preferably 0.15-0.25;
Chromium: 3.00-4.50, preferably 3.50-4.50;
Molybdenum: 4.00-6.00, preferably 4.50-5.50;
Tungsten 0.02-1.50, preferably 0.03-1.40;
Vanadium: 1.50-2.50; preferably 1.70-2.30;
Nickel: 2.00-4.00, preferably 2.50-3.50;
Cobalt: 3.00-7.00, preferably 4.00-6.00;
Silicon: 0.05-0.50, preferably 0.05-0.30;
Manganese: 0.05-0.50, preferably 0.05-0.30;
Iron: balance
as well as the inevitable impurities,
optionally it further comprises one or more of the following elements:
Niobium: ≤2.00;
Nitrogen: ≤0.20;
Aluminum: ≤0.10;
the combined niobium+vanadium content being in the range 1.00-3.50;
and the carbon+nitrogen content being in the range 0.05-0.50.

In particular, the inevitable impurities, notably selected from titanium (Ti), sulfur (S), phosphorus (P), copper (Cu), tin (Sn), lead (Pb), oxygen (O) and mixtures thereof, are kept at the lowest possible level. These impurities are generally due essentially to the method of production and the quality of the charge. Advantageously, the composition according to the invention comprises at most 1 wt % of inevitable impurities, advantageously at most 0.75 wt %, even more advantageously at most 0.50 wt %, relative to the total weight of the composition.

The carbide forming elements, which also have a ferrite stabilizing effect, so-called alpha forming elements, are essential to the steel composition according to the invention in order to provide sufficient hardness, heat resistance and wear resistance. In order to obtain a microstructure free from ferrite, which would weaken the component, it is necessary to add austenite stabilizing elements, so-called gamma forming elements.

A correct combination of austenite stabilizing elements (carbon, nickel, cobalt and manganese) and of ferrite stabilizing elements (molybdenum, tungsten, chromium, vanadium and silicon) makes it possible to obtain a steel composition according to the invention having superior properties, in particular after thermochemical treatment such as carburization.

The steel composition according to the invention therefore comprises carbon (C) in a content in the range 0.05-0.40 wt %, preferably 0.10-0.30 wt %, even more preferably 0.15-0.25 wt %, even more advantageously 0.18-0.20 wt % relative to the total weight of the composition. In fact carbon (C) stabilizes the austenitic phase of the steel at the heat treatment temperatures and is essential for the formation of carbides that supply the mechanical properties in general, notably mechanical strength, high hardness, heat resistance and wear resistance.

The presence of a small amount of carbon in a steel is beneficial to prevent the formation of undesirable brittle intermetallic particles and to form small amounts of carbides to prevent excessive grain growth during quenching. However, the initial carbon content will not have to be too high, since it is possible to increase the surface hardness of the components formed from the steel composition by carburization. During carburization, carbon is incorporated in the surface layers of the component, so as to obtain a hardness gradient. Carbon is the main element for controlling the hardness of the martensitic phase formed after carburization and heat treatment. In a carburized steel, it is essential to have a solid core with a low carbon content while having a hard surface with a high carbon content after thermochemical treatment of carburization.

The steel composition according to the invention further comprises chromium (Cr) in a content in the range 2.50-5.00%, preferably 3.00-4.50%, even more preferably 3.50-4.50%, even more advantageously 3.80-4.00 wt % relative to the total weight of the composition.

Chromium contributes to the formation of carbides in the steel and is, after carbon, the main element controlling the hardenability of steels.

However, chromium may also promote ferrite and residual austenite. Moreover, increasing the chromium content reduces the maximum quenching temperature. The chromium content of the steel composition according to the invention therefore should not be too high.

The steel composition according to the invention also comprises molybdenum (Mo) in a content in the range 4.00-6.00%, preferably 4.50-5.50%, even more preferably 4.80-5.20 wt % relative to the total weight of the composition.

Molybdenum improves tempering resistance, wear resistance and hardness of the steel. However, molybdenum has a strong stabilizing effect on the ferrite phase and therefore must not be present in too great a quantity in the steel composition according to the invention.

The steel composition according to the invention further comprises tungsten (W) in a content in the range 0.01-1.80%, preferably 0.02-1.50%, even more preferably 0.03-1.40%, advantageously 0.04-1.30%, even more advantageously 0.05-1.30%, in particular 0.1-1.30 wt % relative to the total weight of the composition.

Tungsten is a ferrite stabilizer and a strong carbide forming element. It improves resistance to heat treatment and wear, and hardness by forming carbides. However, it is very expensive and as a ferrite stabilising element it also lowers the surface hardness of steel and especially the properties of ductility and toughness. Solution heat treatment at high temperature is required for this element to perform its role fully.

The steel composition according to the invention further comprises vanadium (V) in a content in the range 1.00-3.00%, preferably 1.50-2.50%, even more preferably 1.70-2.30%, advantageously 2.00-2.30%, in particular 2.00-2.20 wt % relative to the total weight of the composition.

Vanadium stabilizes the ferrite phase and has a strong affinity with carbon and nitrogen. Vanadium provides wear resistance and tempering resistance by forming hard vanadium carbides. Vanadium may be replaced partly with niobium (Nb), which has similar properties.

The combined niobium+vanadium content must therefore be in the range 1.00-3.50 wt % relative to the total weight of the composition.

If niobium is present, its content must be 2.00 wt % relative to the total weight of the composition. Advantageously, the steel composition according to the invention does not comprise niobium.

The steel composition according to the invention also comprises nickel (Ni) in a content in the range 2.00-4.00%, preferably 2.50-3.50%, even more preferably 2.70-3.30%, advantageously 3.00-3.20 wt % relative to the total weight of the composition.

Nickel promotes the formation of austenite and therefore inhibits formation of ferrite. Another effect of nickel is to lower the temperature Ms, i.e. the temperature at which transformation of austenite to martensite begins during cooling. This may prevent the formation of martensite. The amount of nickel must therefore be controlled so as to avoid the formation of residual austenite in the carburized components.

The steel composition according to the invention further comprises cobalt (Co) in a content in the range 2.00-8.00%, preferably 3.00-7.00%, even more preferably 4.00-6.00%, advantageously 4.50-5.50%, more advantageously 4.90-5.40%, more particularly 4.90-5.20 wt % relative to the total weight of the composition.

Cobalt is a strong austenite stabilizing element that prevents undesirable ferrite formation. In contrast to nickel, cobalt increases the temperature Ms, which in its turn decreases the amount of residual austenite. Cobalt, together with nickel, allows the presence of ferrite stabilizers such as the carbide forming elements Mo, W, Cr and V. Carbide forming elements are essential for the steel according to the invention on account of their effect on hardness, heat resistance and wear resistance. Cobalt has a small effect of increasing steel hardness. However, the increase in hardness is correlated with a decrease in toughness. Therefore the steel composition according to the invention should not contain too much cobalt.

The steel composition according to the invention may further comprise silicon (Si) in a content ≤0.70 wt % relative to the total weight of the composition. Advantageously, it comprises silicon, in particular in a content in the range 0.05-0.50 wt %, preferably 0.05-0.30 wt %, advantageously 0.07-0.25 wt %, even more advantageously 0.10-0.20 wt % relative to the total weight of the composition.

Silicon strongly stabilizes ferrite, but is often present in the steelmaking process during deoxidation of molten steel. Low oxygen contents are in fact also important for obtaining low levels of nonmetallic inclusions and good mechanical properties such as fatigue strength and mechanical strength.

The steel composition according to the invention may further comprise manganese (Mn) in a content ≤0.70 wt % relative to the total weight of the composition. Advantageously, it comprises manganese in particular in a content in the range 0.05-0.50 wt %, preferably 0.05-0.30 wt %, advantageously 0.07-0.25 wt %, even more advantageously 0.10-0.22 wt %, even more particularly 0.10-0.20 wt % relative to the total weight of the composition.

Manganese stabilizes the austenite phase and decreases the temperature Ms in the steel composition. Manganese is generally added to steels during steelmaking so that it becomes attached to sulfur by formation of manganese sulfide during solidification. This eliminates the risk of formation of iron sulfides, which have an unfavorable effect on the hot working of the steels. Manganese is also involved in the deoxidation step, like silicon. Combining manganese with silicon gives more effective deoxidation than each of these elements individually.

Optionally, the steel composition according to the invention may comprise nitrogen ($N_2$), in a content ≤0.50 wt %, preferably ≤0.20 wt % relative to the total weight of the composition.

Nitrogen promotes the formation of austenite and reduces the transformation of austenite to martensite. Nitrogen may to a certain extent replace carbon in the steel according to the invention. However, the carbon+nitrogen content must be in the range 0.05-0.50 wt % relative to the total weight of the composition.

Optionally, the steel composition according to the invention may comprise aluminum (Al), in a content ≤0.15 wt %, preferably ≤0.10 wt % relative to the total weight of the composition.

Aluminum (Al) may in fact be present during production of the steel according to the invention and contributes very effectively to deoxidation of molten steel. This is particularly the case in remelting processes such as the VIM-VAR process. The aluminum content is generally higher in the steels produced using the VIM-VAR process than in the steels obtained by powder technology. Aluminum causes difficulties during atomization by obstructing the pouring nozzle with oxides. A low oxygen content is important for obtaining good micro-purity as well as good mechanical properties such as fatigue strength and mechanical strength. The oxygen contents obtained by the ingot route are typically below 15 ppm.

Advantageously, the composition according to the present invention is carburizable, i.e. it can undergo a carburization treatment, and/or nitritable, i.e. it can undergo a nitriding treatment and even advantageously it can undergo a thermochemical treatment, in particular selected from carburization, nitriding, carbonitriding and carburization followed by nitriding.

These treatments make it possible to improve the surface hardness of the steel, by adding the elements carbon and/or nitrogen. Thus, if carburization is used, the carbon content of the surface of the steel increases and therefore its surface hardness increases. The surface is thus advantageously enriched with carbon with enrichment in particular between 0.5-1.7 wt %, relative to the total weight of the composition.

If nitriding is used, it is the nitrogen content that increases at the surface of the steel, and therefore its surface hardness also increases.

If carbonitriding or carburization followed by nitriding are used, it is the contents of carbon and nitrogen at the surface of the steel that are increased, and therefore also its surface hardness.

These methods are familiar to a person skilled in the art.

In an advantageous embodiment, the steel composition according to the invention has, after thermochemical treatment, advantageously of carburization or nitriding or carbonitriding or carburization and then nitriding, followed by heat treatment, a surface hardness greater than or equal to 64 HRC, advantageously greater than or equal to 65 HRC, even more advantageously greater than or equal to 66 HRC, measured according to standard ASTM E18 or an equivalent standard. The steel composition obtained as a result of these treatments advantageously has a surface concentration of carbon between 1 and 1.25 wt % relative to the total weight of the composition.

Said heat treatment may comprise:

(1) a solution heat treatment of the steel at a temperature between 1090° C.-1160° C., advantageously between 1100° C.-1160° C., more advantageously between 1100 and 1155° C., in particular between 1100 and 1150° C., more particularly of 1150° C., (2) followed advantageously by holding at this temperature until there is complete austenitization, in particular for 15 minutes (quenching), (these 2 steps (1) and (2) allow complete or partial dissolution of the carbides initially present), (3) and then optionally a first cooling (quenching), in particular under a neutral gas, for example at a pressure of 2 bar, advantageously to room temperature (this step makes it possible to obtain a microstructure that is mainly martensitic with residual austenite. This residual austenite is a function of the cooling temperature: the content decreases with the cooling temperature), (4) optionally followed by holding at room temperature, (5) and then advantageously a second cooling to a temperature below −40° C., more advantageously below −60° C., even more advantageously of about −75° C., in particular for 2 hours (this step makes it possible to lower the content of residual austenite), (6) and advantageously one or more tempering operations, more advantageously at least three tempering operations, advantageously at a temperature greater than or equal to 475° C., more advantageously greater than or equal to 500° C., in particular greater than or equal to 550° C., more particularly of about 560° C., even more particularly for 1 hour each (this or these tempering operations allow precipitation of carbides and partial or complete decomposition of the residual austenite. This makes it possible to obtain properties of ductility).

The advantage of the steel according to the invention is therefore that high levels of hardness are obtained with limited heat treatment (temperature between 1090° C.-1160° C., advantageously between 1100° C.-1160° C., more advantageously between 1100° C.-1155° C., in particular between 1100° C.-1150° C., more particularly of 1150° C.).

In a particularly advantageous embodiment, the steel composition according to the invention has, after thermochemical treatment, advantageously of carburization or nitriding or carbonitriding or carburization and then nitriding, followed by heat treatment, a martensitic structure having a residual austenite content below 10 wt % and that is free from ferrite and pearlite, phases that are known to decrease the surface hardness of steel.

Said heat treatment may be as described above.

The present invention further relates to a method for producing a steel blank having the composition according to the invention, characterized in that it comprises:

a) a steelmaking step;

b) a step of processing the steel;

c) a thermochemical treatment;

d) and a heat treatment.

Advantageously the heat treatment in step d) of the method according to the present invention is as described above.

Advantageously, the thermochemical treatment in step c) of the method according to the present invention consists of a treatment of carburization or nitriding or carbonitriding or carburization and then nitriding, and advantageously it is a carburization treatment.

In particular, step b) of the method according to the present invention consists of a step of rolling, forging and/or extrusion. These methods are familiar to a person skilled in the art.

In an advantageous embodiment, the making step a) of the method according to the present invention is carried out by a conventional making process of arc furnace refining and electro slag remelting (ESR), or by a VIM-VAR process, optionally with a step of electro slag remelting (ESR) and/or vacuum arc remelting (VAR), or by powder metallurgy such as gas atomization and compression by hot isostatic pressing (HIP).

Thus, the steel according to the present invention may be produced by a VIM-VAR process. This process gives very good cleanness with respect to inclusions and improves the chemical homogeneity of the ingot. It is also possible to employ a route of electro slag remelting (ESR) or to combine the ESR and VAR (vacuum arc remelting) operations.

This steel may also be obtained by powder metallurgy. This method makes it possible to produce metal powder of high purity by atomization, preferably gas atomization for obtaining very low oxygen contents. The powder is then compressed for example by hot isostatic pressing (HIP).

These methods are familiar to a person skilled in the art.

The present invention also relates to a steel blank obtainable by the method according to the invention. This blank is made on the basis of steel having the composition according to the present invention and as described above.

It further relates to the use of a blank according to the invention or of a steel composition according to the invention for making a mechanical device, advantageously in the field of transmission such as gear trains, transmission shafts and bearings.

It finally relates to a mechanical device, advantageously a transmission device or a gear train, in particular a gear train, a transmission shaft or a bearing, more particularly a bearing, in steel having the composition according to the invention or obtained from a steel blank according to the invention.

In fact, with the steel composition according to the invention, it is possible to combine high surface hardness and resistance to surface wear with a core that has high resistance to fatigue and high mechanical strength.

These steels are therefore usable in demanding fields such as bearings for aerospace applications.

Furthermore, the steel obtained is inexpensive owing in particular to the low tungsten content, despite having a high level of surface hardness after thermochemical treatment, with a martensite structure free from massive phases of the austenite or ferrite or pearlite type.

The invention will be better understood on reading the following examples and figures, which are given as a nonlimiting guide.

In the examples, unless stated otherwise, all the percentages are expressed by weight, the temperature is expressed in degrees Celsius and the pressure is atmospheric pressure.

FIG. 1 shows the profile of surface hardness (microhardness in HV0.5 as a function of depth in the steel (in mm) of two examples according to the invention (grades B and C) and of a comparative example (grade A) according to application WO2015/082342 having the composition shown in Table 1 below as well as of a comparative example 50 NiL (0.12% C-4% Cr-4.2% Mo-3.4% Ni-1% V), obtained after carburization and heat treatment comprising the following steps: (1) heating to 1150° C., (2) holding for 15 min at 1150° C. for austenitization, (3) cooling under neutral gas at a pressure of 2 bar, (4) a period at room temperature, (5) cooling to −75° C. for 2 hours, and (6) 3 tempering operations at 550° C. for grade C and 560° C. for grades A and B for 1 hour each.

Figure 2:
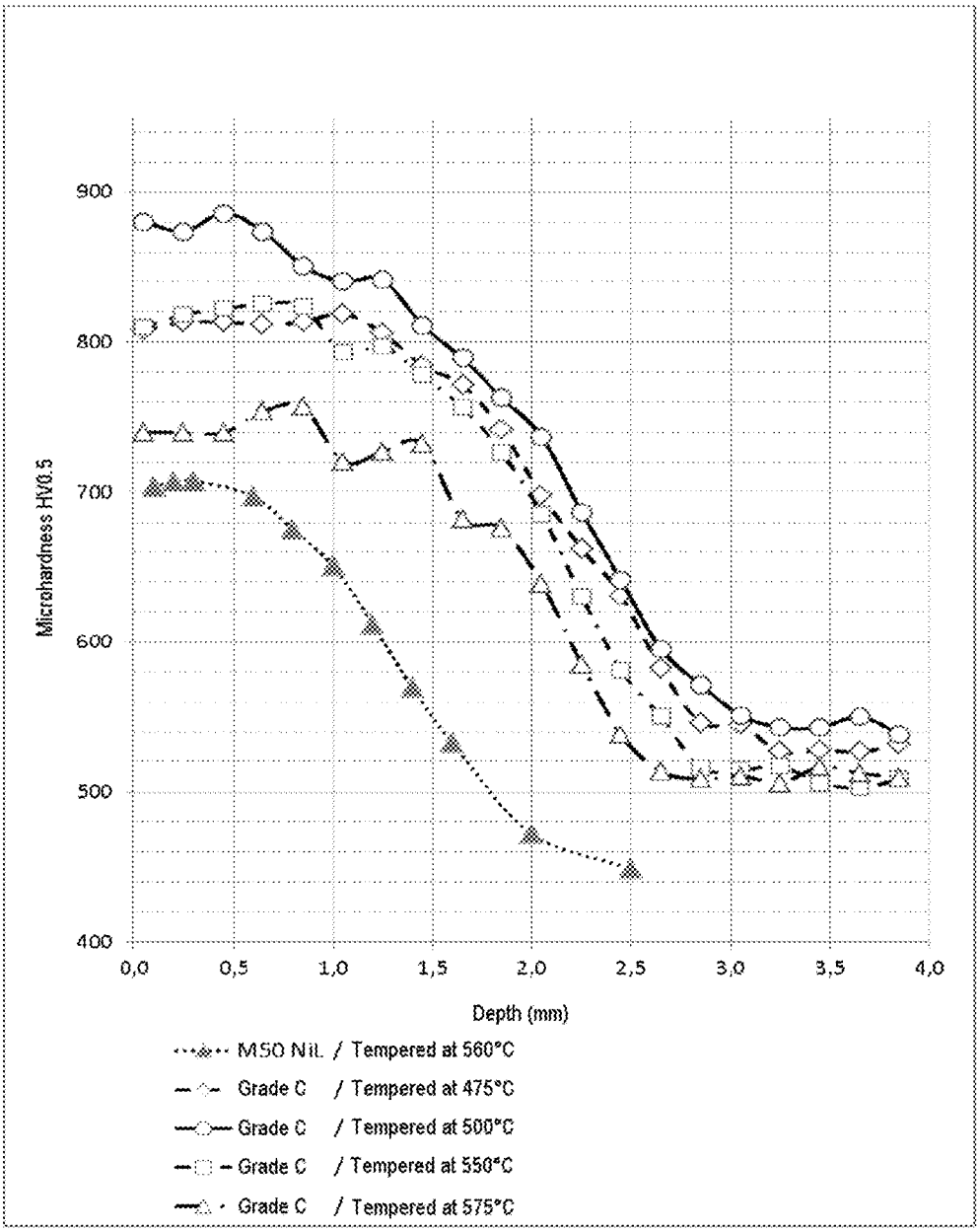

FIG. 2 shows the profile of surface hardness (microhardness in HV0.5 as a function of depth in the steel (in mm) from example 2 (grade C) according to the invention having the composition shown in Table 1 below as well as of a comparative example 50 NiL (0.12% C-4% Cr-4.2% Mo-3.4% Ni-1% V), obtained after carburization and heat treatment comprising the following steps: (1) heating to 1100° C., (2) holding for 15 min at 1100° C. for austenitization, (3) cooling under neutral gas at a pressure of 2 bar, (4) a period at room temperature, (5) cooling to −75° C. for 2 hours, and (6) 3 tempering operations at a temperature of 475° C. or 500° C. or 550° C. or 575° C. for grade C or of 560° C. for the comparative example 50 NiL for 1 hour each.

Figure 3:
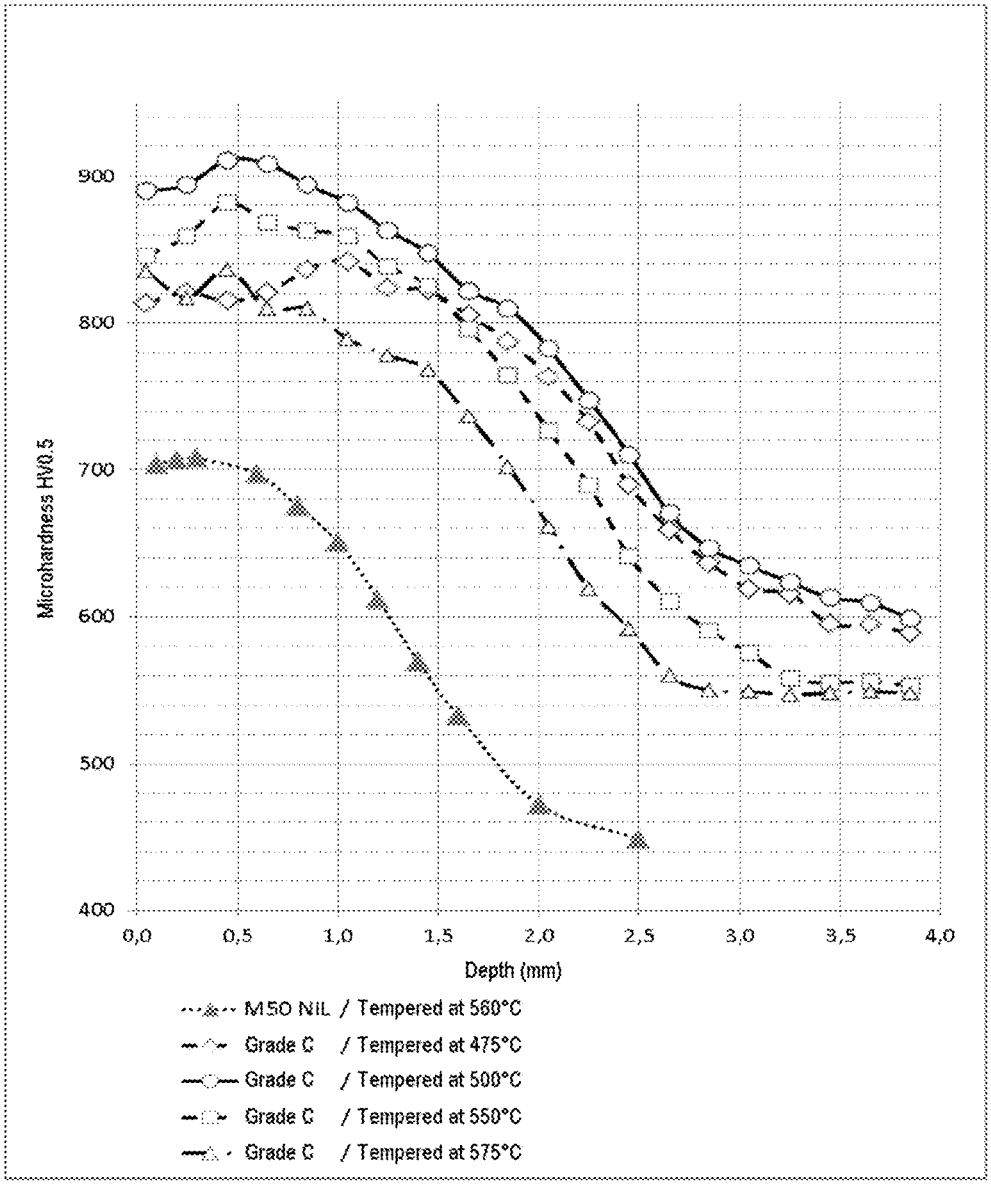

FIG. 3 shows the profile of surface hardness (microhardness in HV0.5 as a function of depth in the steel (in mm) from example 2 (grade C) according to the invention having the composition shown in Table 1 below as well as of a comparative example 50 NiL (0.12% C-4% Cr-4.2% Mo-3.4% Ni-1% V), obtained after carburization and heat treatment comprising the following steps: (1) heating to 1150° C., (2) holding for 15 min at 1150° C. for austenitization, (3) cooling under neutral gas at a pressure of 2 bar, (4) a period at room temperature, (5) cooling to −75° C. for 2 hours, and (6) 3 tempering operations at a temperature of 475° C. or 500° C. or 550° C. or 575° C. for grade C or of 560° C. for the comparative example 50 NiL for 1 hour each.

EXAMPLES 1 AND 2

Three laboratory casts each of about 110 kg (two examples according to the invention: example 1 and example 2 and a comparative example according to application WO2015/082342: comparative example 1) were produced by the VIM-VAR process according to the composition shown in Table 1 below:

TABLE 1

| | | Element | | | | | | |
|---|---|---|---|---|---|---|---|---|
| | | C | Si | Mn | Ni | Cr | Mo | W |
| Comparative example 1: GRADE A | Min. | 0.18 | 0.10 | 0.10 | 3.00 | 3.80 | 4.80 | 3.00 |
| | Max. | 0.20 | 0.20 | 0.20 | 3.20 | 4.00 | 5.20 | 3.20 |
| Example 1: GRADE B | Min. | 0.18 | 0.10 | 0.10 | 3.00 | 3.80 | 4.80 | 1.10 |
| | Max. | 0.20 | 0.20 | 0.20 | 3.20 | 4.00 | 5.20 | 1.30 |
| Example 2: GRADE C | Min. | 0.18 | 0.14 | 0.180 | 3.05 | 3.90 | 5.00 | 0.10 |
| | Max. | 0.20 | 0.16 | 0.220 | 3.09 | 4.00 | 5.20 | 0.20 |

| | | Element | | | | | | | |
|---|---|---|---|---|---|---|---|---|---|
| | | Al | V | Co | Cu | $N_2$ | $O_2$ | S | P |
| Comparative example 1: GRADE A | Min. | 0.03 | 2.00 | 4.90 | | | | | |
| | Max. | 0.07 | 2.20 | 5.20 | <0.10 | <0.01 | <0.002 | <0.001 | <0.005 |
| Example 1: GRADE B | Min. | 0.03 | 2.00 | 4.90 | | | | | |
| | Max. | 0.07 | 2.20 | 5.20 | <0.10 | <0.01 | <0.002 | <0.001 | <0.005 |
| Example 2: GRADE C | Min. | 0.03 | 2.10 | 5.00 | | | | | |
| | Max. | 0.05 | 2.30 | 5.40 | <0.10 | <0.01 | <0.002 | <0.001 | <0.005 |

These three compositions are very similar. The main difference is in the content of W.

These three laboratory casts were transformed into bar with a diameter of 40 mm by a hot forging process under a 2000 T press. Bars with a diameter of 30 mm were machined from the bar and carburized.

The carburized bars were treated by (1) heating to 1100° C. or 1150° C., (2) holding for 15 min at this temperature for austenitization, (3) cooling under neutral gas at a pressure of 2 bar, (4) a period at room temperature, (5) cooling to −75° C. for 2 hours, and (6) 3 tempering operations at a temperature between 475° C. and 560° C. for 1 hour each.

The profiles of surface hardness in HV obtained, measured according to standard ASTM E384, are compared in FIGS. 1 to 3 with those obtained with steel 50 NiL (0.12% C-4% Cr-4.2% Mo-3.4% Ni-1% V) that underwent the same treatment of austenitization and cooling to room temperature and then cold, and 3 tempering operations at 560° C.

The compositions according to the invention having a low W content have higher levels of hardness, of the order of 860 HV, corresponding to 66 HRC. It should also be noted that lowering the W content relative to the prior art does not significantly affect the level of hardness of the base metal, which is of the order of 540 HV, corresponding to 51 HRC.

The steel having the composition according to the invention (low W content) therefore makes it possible to obtain higher levels of hardness with a heat treatment limited to 1150° C. relative to that of the prior art with a higher W content.

It should also be pointed out that a tempering temperature of 500° C. is particularly advantageous since the level of hardness reaches 66-67 HRC (with solution heat treatment at 1100° C. and 1150° C.) (FIGS. 2 and 3).

At 575° C., the results are still very advantageous with values above 64 HRC after solution heat treatment at only 1150° C. (FIG. 3).

The invention claimed is:

1. A steel composition carburizable and/or nitritable comprising, in percentages by weight of the total composition:

Carbon: 0.05-0.40;
Chromium: 2.50-5.00;
Molybdenum: 4.00-6.00;
Tungsten: 0.01-1.80;
Vanadium: 1.00-3.00;
Nickel: 2.00-4.00;
Cobalt: 2.00-8.00;
Iron: balance as well as the inevitable impurities,
optionally further comprising one or more of the following elements:

Niobium: ≤2.00;
Nitrogen: ≤0.50;
Silicon: ≤0.70;
Manganese: ≤0.70;
Aluminum: ≤0;

the combined niobium+vanadium content being in the range 1.00-3.50;
and the carbon+nitrogen content being in the range 0.05-0.50.

2. The steel composition as claimed in claim 1, wherein it comprises, in percentages by weight of the total composition:

Carbon: 0.10-0.30;
Chromium: 3.00-4.50;
Molybdenum: 4.00-6.00;
Tungsten 0.02-1.50;
Vanadium: 1.50-2.50;
Nickel: 2.00-4.00;
Cobalt: 3.00-7.00;
Silicon: 0.05-0.50;
Manganese: 0.05-0.50;
Iron: balance as well as the inevitable impurities,
optionally further comprising one or more of the following elements:

Niobium: ≤2.00;
Nitrogen: ≤0.20;
Aluminum: ≤0.10;

the combined niobium+vanadium content being in the range 1.00-3.50;
and the carbon+nitrogen content being in the range 0.05-0.50.

3. The steel composition as claimed in claim 1, wherein it comprises at most 1 wt % of inevitable impurities relative to the total weight of the composition.

4. The steel composition as claimed in claim 1, wherein the inevitable impurities are selected from titanium, sulfur, phosphorus, copper, tin, lead, oxygen and mixtures thereof.

5. The steel composition as claimed in claim 1, wherein the tungsten content is in the range 0.03-1.40 in percentages by weight of the total composition.

6. The steel composition as claimed in claim 5, wherein the tungsten content is in the range 0.04-1.30 in percentages by weight of the total composition.

7. The steel composition as claimed in claim 1, wherein, after thermochemical treatment, followed by heat treatment, it has a surface hardness greater than or equal to 64 HRC.

8. The steel composition as claimed in claim 7, wherein the heat treatment comprises solution heat treatment at a temperature between 1090° C.-1160° C. followed by quenching optionally with cooling to a temperature below −40° C. and several tempering operations, at a temperature greater than or equal to 475° C.

9. The steel composition as claimed in claim 1, wherein, after thermochemical treatment, followed by heat treatment, it has a martensitic structure having a residual austenite content below 10% and that is free from ferrite and pearlite.

10. A mechanical device, formed from steel having the composition as claimed in claim 1.

11. The mechanical device according to claim 10, which is a bearing or a gear train.

12. A method for producing a steel blank having the composition as claimed in claim 1, wherein it comprises:

a) a steelmaking step;
b) a step of processing the steel;
c) a thermochemical treatment;
d) and a heat treatment.

13. The production method as claimed in claim 12, wherein step b) consists of a step of rolling, forging and/or extrusion.

14. The production method as claimed in claim 12, wherein the steelmaking step a) is carried out by a conventional production process of arc furnace refining and electro slag remelting (ESR), or by a VIM-VAR process, optionally with a step of electro slag remelting (ESR) and/or vacuum arc remelting (VAR), or by powder metallurgy.

15. A steel blank obtainable by a method as claimed in claim 12.

16. The production method as claimed in claim 12, wherein step c) consists of a treatment of carburization or nitriding or carbonitriding or carburization and then nitriding.

17. The production method as claimed in claim 16, wherein step c) consists of a treatment of carburization.

18. The production method as claimed in claim 12, wherein step d) comprises solution heat treatment at a temperature between 1090° C.-1160° C., followed by holding at this temperature until there is complete austenitization optionally with cooling to a temperature below −40° C., and several tempering operations, at a temperature greater than or equal to 475° C.

19. The production method as claimed in claim 18, wherein the tempering operations are carried out at a temperature greater than or equal to 500° C.

20. The production method as claimed in claim 18, wherein the heat treatment is carried out at a temperature between 1100° C.-1150° C.

* * * * *